US005469661A

United States Patent [19]

Finkelstein et al.

[11] Patent Number: 5,469,661

[45] Date of Patent: Nov. 28, 1995

[54] SLIDING DOOR FOOT TREADLE

[75] Inventors: Burl Finkelstein, Shenandoah; Thomas A. Thorsen, Moreland, both of Ga.

[73] Assignee: Kason Industries, Inc., Shenandoah, Ga.

[21] Appl. No.: 298,677

[22] Filed: Aug. 31, 1994

[51] Int. Cl.[6] ..... E05F 11/00

[52] U.S. Cl. ..... 49/276; 49/235

[58] Field of Search ..... 49/276, 278, 209, 49/210, 225, 235

[56] References Cited

U.S. PATENT DOCUMENTS

| | | | |
|---|---|---|---|
| 854,262 | 5/1907 | Young | 49/276 X |
| 1,244,910 | 10/1917 | Smith | 49/276 X |
| 1,611,386 | 12/1926 | Stanley | 49/276 X |
| 3,007,695 | 11/1961 | Bell, Jr. | 49/278 X |
| 3,012,837 | 12/1961 | Morrissey, Jr. | 49/276 |
| 5,257,477 | 11/1993 | Kvasnes | 49/235 |

*Primary Examiner*—Philip C. Kannan
*Attorney, Agent, or Firm*—Kennedy & Kennedy

[57] ABSTRACT

A foot treadle for use in opening a sliding door of the type mounted for initial movement in three directional dimensions from its closed position comprises a lever having an axis of rotation. The lever has a leg that depends generally downwardly from the axis and an arm that extends generally laterally from the axis. A pedal is mounted to the arm distally from the axis of rotation. The lever is mounted to a door jamb of a sliding door with the lever leg closely adjacent a lower end of the door for pivotal movement about the lever axis of rotation in pushing and sliding engagement with the door lower end. Upon a person stepping upon the pedal the lever leg applies a force laterally and upwardly against the door lower end thereby urging the door laterally and upwardly out of sealed engagement with the door jamb and floor as the door lower end slides outwardly from the door jamb in sliding contact with the lever leg.

3 Claims, 2 Drawing Sheets

SLIDING DOOR FOOT TREADLE

TECHNICAL FIELD

The present invention relates to foot treadles used to assist in opening heavy doors. More particularly, the invention relates to a foot treadle for opening sliding doors.

BACKGROUND OF THE INVENTION

In the food industry, many perishable foods require refrigeration for lengthy storage. Restaurants, cafeterias and other high volume food preparers typically have large refrigeration units for storing perishable food items. The heavy doors of these refrigeration units are usually tightly sealed making them difficult to open. Often the person who uses the refrigeration unit has his or her hands full when needing to open the door which makes opening the door an even more difficult task.

For refrigerator doors which open by swinging outwardly, foot treadles have been employed to assist in opening the doors more easily and without the need for a person to use his or her hands. These foot treadles have typically been designed with foot pedals attached to door jambs. One end of the foot pedal contacts a breaker plate mounted to the door that extends over the foot pedal. By stepping onto the other end of the foot pedal, it applies a force to the breaker plate that creates a moment that causes the door to swing about its pivotal mount outwardly thereby breaking the door seal. The door may then be readily opened.

Sliding refrigerator doors have the same problem with regard to opening since they are also typically sealed closed. Foot treadles used for swinging doors, however, may not be used with sliding doors since application of a force to their face only accomplishes breaking the door seal. Sliding doors are typically suspended from overhead tracks which cause the sliding doors to travel in all three X, Y and Z three directional dimensions as they move into and out of their sealed, closed position. The sliding doors initially move slightly upwardly from their seal with the floor and outwardly from their seal with the door jamb as they commence their sliding motion, and thereafter only slide laterally.

Thus, it is seen that there remains a need for a foot treadle for sliding doors. Accordingly, it is to the provision of such that the present invention is primarily directed.

SUMMARY OF THE INVENTION

In a preferred embodiment, a foot treadle for use in opening a sliding door of the type mounted for initial movement in three directional dimensions from its closed position comprises a lever having an axis of rotation. The lever has a leg that depends generally downwardly from the axis and an arm that extends generally laterally from the axis. A pedal is mounted to the arm distally from the axis of rotation. The foot treadle has means for mounting the lever to a door jamb of a sliding door with the lever leg closely adjacent a lower end of the door for pivotal movement about the lever axis of rotation in pushing and sliding engagement with the door lower end. Upon a person stepping upon the pedal, the lever leg applies a force laterally and upwardly against the door lower end thereby urging the door laterally and upwardly out of sealed engagement with the door jamb and floor as the door lower end slides outwardly from the door jamb in sliding contact with the lever leg.

DETAILED DESCRIPTION OF THE INVENTION

Figure 2:
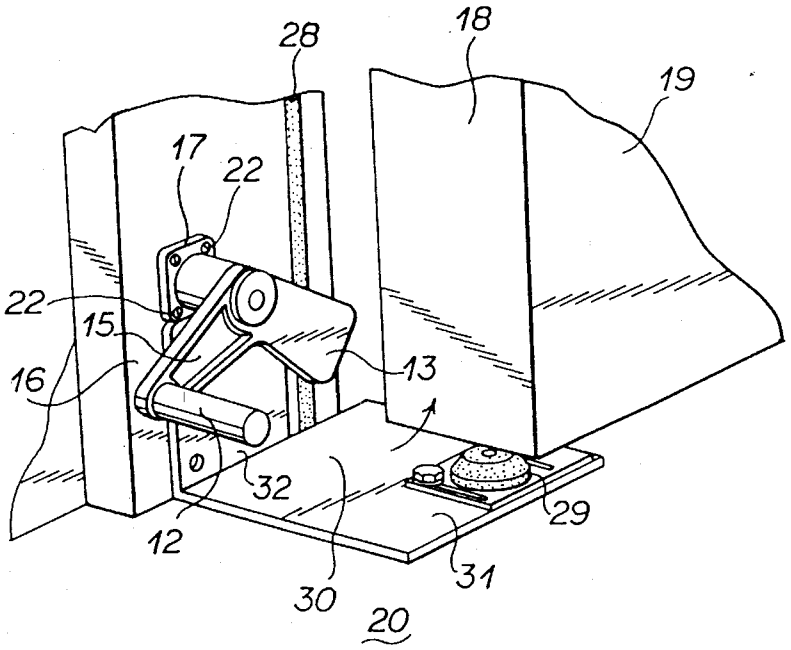
FIG. 2 is a perspective view of the foot treadle shown being operated in opening the door.

Referring now in more detail to the drawings, in which like numerals indicate like parts throughout the several views, a foot treadle 10 is shown having an inverted L-shaped lever 11 and a pedal 12. The L-shaped lever 11 has a leg 13 unitarily joined at an elbow 14 to an arm 15. The pedal 12 extends normally from the lever 11 at the end of the arm 15 distal to the elbow 14.

Figure 1:
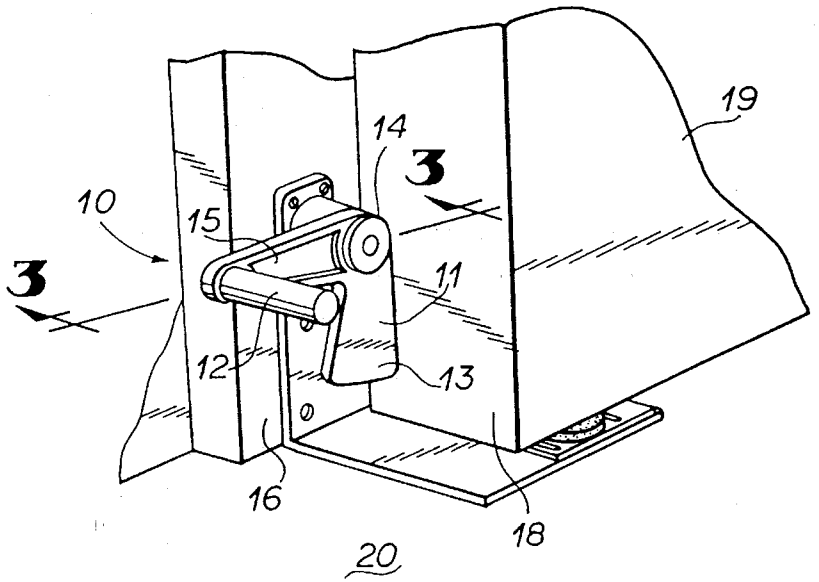
FIG. 1 is a perspective view of a foot treadle embodying principles of the invention in a preferred form shown in a resting position adjacent a closed refrigerator door.

The foot treadle 10 is pivotably mounted at the elbow 14 near the bottom of a door jamb 16. As best shown in FIG. 2, this is done by mounting means that comprises a flanged foot 17. The leg 13 is positioned closely adjacent to the bottom of an end 18 of a sliding door 19 with the door closed as shown in FIG. 1. The side edge of the leg 13 has a smooth surface to easily slide over the surface of the end 18 of the sliding door 19 during operation of the foot treadle 10. The end of the leg 13 is above a floor 20 such that the foot treadle 10 has free pivotal movement without interference with the floor 20.

Figure 3:
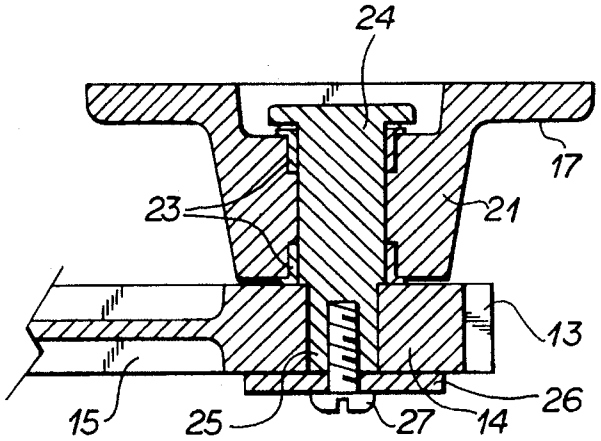
FIG. 3 is a cross-sectional view of a portion of the foot treadle.

As shown in FIG. 3, the flange foot 17 itself is comprised of a base 21 with a bore extending centrally therethrough. The base 21 is mounted to the door jamb 16 by screws 22, as best shown in FIG. 2. Two bearings 23 are mounted in opposite ends of the bore. A rotatable pin 24, which provides an axle by which the foot treadle 10 pivots, is fitted snugly within the bore in contact with the bearings 23. An end 25 of the rotatable pin 24 extends outwardly from the base 21 through a bore in the elbow 14 of the lever 11. The end 25 of the pin 24 has a knurled surface which press fits and keys the lever 11 to the flange foot 17. Finally, a washer 26 and a screw 27 secure the pin 24 fixedly to the lever 11 whereby it may rotate freely on the base 21.

The sliding door 19 is sealed tightly by engagement of its principal inside with a resilient, rubber, tubular seal 28 mounted to the door jamb 16 and by engagement of its bottom with another unshown seal mounted to the floor 20. The bottom of the door 19 here also engages a guide roller 29 that is mounted to the floor 20 by a mounting bracket 30, which, as shown in FIG. 2, has a floor plate 31 which the guide roller 29 is mounted upon and a wall plate 32 which is screwed to the door jamb 16.

Figure 4:
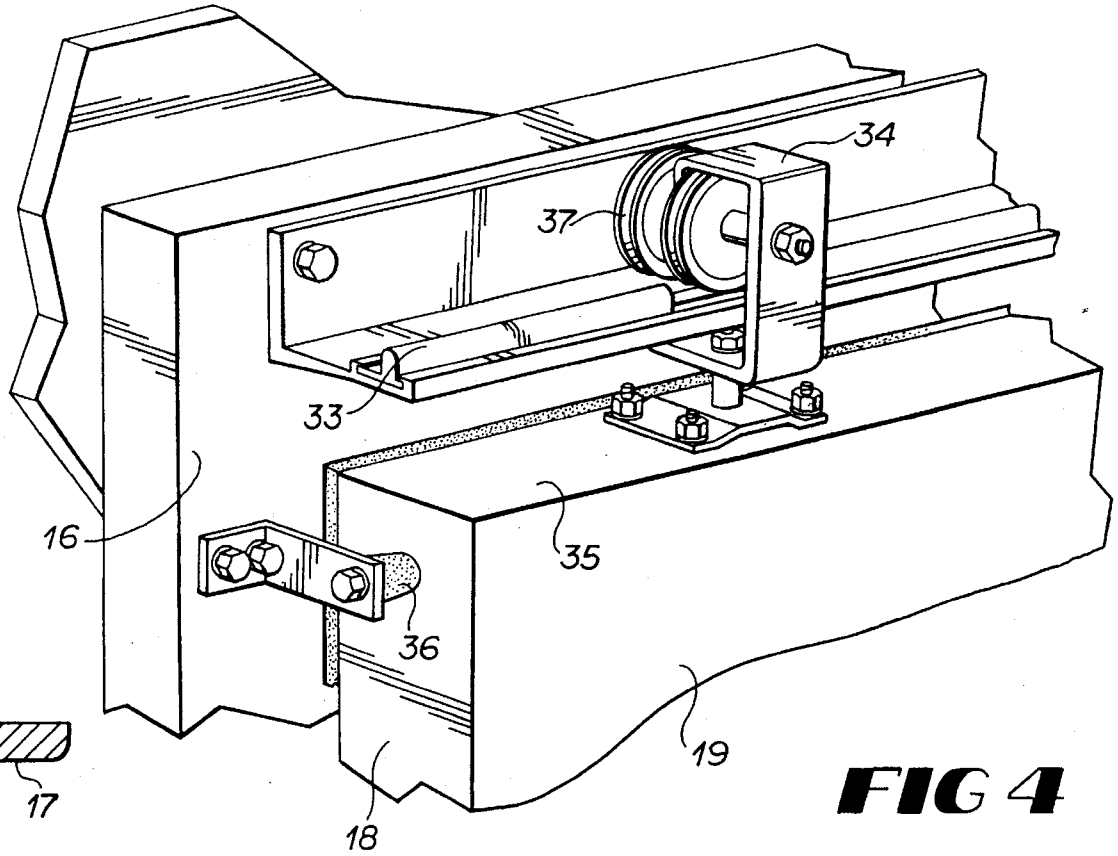
FIG. 4 is a perspective view of a corner portion of the refrigerator door shown suspended from an overhead track.

As shown in FIG. 4, the sliding door 19 is suspended from a track 33, which is mounted above the door opening to the door jamb 16, by a trolley 34 mounted to each end of the top 35 of the sliding door 19. The trolleys 34 guide the sliding door 19 beneath the track 33 in essentially sideways or lateral directions. However, as the sliding door 19 is brought to rest against a stop 36 and away therefrom, it moves not only sideways in an X-axis dimensional direction, but also in Y and Z dimensional directions. The sliding door 19 is brought into and out of sealing engagement with the seal 28 and the floor seal without substantial rubbing contact with the seals. This is caused by a slight depression and jog in the track 33 as shown just beneath trolley wheels 37 in FIG. 4 which, of course, the trolleys 34 follow.

The foot treadle 10 is manually used to facilitate the initial opening of the sliding door 19 and the breaching of its sealed relation with the door jamb 16 and the floor 20. In doing so, a person merely steps down on the pedal 12 in its position shown in FIG. 1. This causes the lever 11 to pivot counter-clockwise. The leg 13 cams and drives the sliding door 19 to the right and slightly upwardly as indicated by the arrow in FIG. 2. The sliding door 19 begins to move from the door jamb 16 to the right in the X sliding direction and also slightly upwardly in the Y direction and slightly outwardly from the door jamb 16 in the Z direction. Though the foot treadle 10 does not apply a force vector in the Z direction, the sliding door 19 is permitted to move in the Z direction as the trolleys 34 follow the path of the overhead track 33 by virtue of the door end 18 sliding along the surface of the leg 13 of the lever 11 as it pushes the sliding door 19. This upwardly and outwardly movement brings the sliding door 19 out of engagement with the door jamb 16 releasing the side seal 28 and floor seal and lifts the sliding door over the guide roller 29. Following the upwardly and outwardly movement the sliding door 19 moves only sideways in the X direction. As the sliding door gains momentum and begins to move purely sideways, it can now be easily pushed as by a person's forearm. When closing the sliding door 19, it is pushed in a reverse direction in a substantially level plane. Not until the sliding door 19 fully closes is it moved back into its initial, sealed position as shown in FIG. 1.

Thus, it is seen that a foot treadle for a sliding door is now provided of simple, economic construction and operation. While this invention has been described in detail with reference to its preferred embodiment, it should be understood that many modifications, additions and deletions may be made thereto without departure from the spirit and scope of the invention as set forth in the following claims.

What I claim is:

1. A foot treadle for use in opening a sliding door of the type mounted for initial movement in three directional dimensions from its closed position, and with the foot treadle comprising, in combination:

a lever having an axis of rotation, a leg that depends generally downwardly from said axis, and an arm that extends generally laterally from said axis;

a pedal mounted to said arm distally from said axis of rotation; and means for mounting said lever to a door jamb of a sliding door with said lever leg positioned closely adjacent a lower end of the door for pivotal movement about said lever axis of rotation in pushing and sliding engagement with the door lower end, whereby upon a person stepping upon the pedal the lever leg applies a force laterally and upwardly against the door lower end thereby urging the door laterally and upwardly out of sealed engagement with the door jamb and floor as the door lower end slides outwardly from the door jamb in sliding contact with the lever leg.

2. The foot treadle of claim 1 wherein said pedal is mounted normally to said lever arm.

3. A foot treadle for a sliding door comprising a generally inverted L-shaped member having an arm and a leg extending generally right-angularly from said arm at a pivotal joint, a pedal mounted generally right-angularly to an end of said arm located distally from said pivot joint, and means for pivotably mounting said L-shaped member pivotal joint to a door jamb adjacent a lower end of a sliding door in its closed position.

* * * * *